US009464828B2

(12) United States Patent
Cocchi et al.

(10) Patent No.: US 9,464,828 B2
(45) Date of Patent: Oct. 11, 2016

(54) NATURAL COOLANT REFRIGERATING PLANT

(75) Inventors: Andrea Cocchi, Calderara di Reno (IT); Roberto Lazzarini, Reggio Emilia (IT)

(73) Assignee: ALI S.p.A.—CARPIGIANI GROUP, Milan (IT)

( * ) Notice: Subject to any disclaimer, the term of this patent is extended or adjusted under 35 U.S.C. 154(b) by 1042 days.

(21) Appl. No.: 13/529,551

(22) Filed: Jun. 21, 2012

(65) Prior Publication Data

US 2013/0000338 A1 Jan. 3, 2013

(30) Foreign Application Priority Data

Jun. 29, 2011 (IT) ..... BO2011A0384

(51) Int. Cl.
*F25B 29/00* (2006.01)
*F25B 1/10* (2006.01)
*F25B 9/00* (2006.01)

(52) U.S. Cl.
CPC ..... *F25B 29/003* (2013.01); *F25B 1/10* (2013.01); *F25B 9/008* (2013.01); *F25B 2309/061* (2013.01); *F25B 2600/2507* (2013.01); *F25B 2600/2515* (2013.01)

(58) Field of Classification Search
CPC ..... F25B 1/10; F25B 9/008; F25B 2309/06; F25B 2309/061
USPC ..... 62/196.1, 197
See application file for complete search history.

(56) References Cited

U.S. PATENT DOCUMENTS

| | | | | |
|---|---|---|---|---|
| 2,024,323 | A | 12/1935 | Wyld | |
| 2005/0072173 | A1 | 4/2005 | Yamasaki et al. | |
| 2005/0279127 | A1* | 12/2005 | Jia et al. | 62/510 |
| 2010/0251761 | A1 | 10/2010 | Yoshimi et al. | |
| 2010/0300141 | A1 | 12/2010 | Fujimoto et al. | |
| 2011/0154840 | A1* | 6/2011 | Mihara et al. | 62/196.1 |

FOREIGN PATENT DOCUMENTS

| | | |
|---|---|---|
| EP | 2339266 | 6/2011 |

OTHER PUBLICATIONS

Italian Search Report dated Mar. 5, 2012 from counterpart application.

* cited by examiner

*Primary Examiner* — Jonathan Bradford
(74) *Attorney, Agent, or Firm* — Shuttleworth & Ingersoll, PLC; Timothy J. Klima

(57) ABSTRACT

A natural coolant refrigerating plant includes a motor-driven compressor with two compression stages, at least one jacket for heating and/or cooling a product being processed, an intercooler located upstream of the second compression stage and a gas-cooler located downstream of an outlet from a second compression stage. A first branch connects an outlet of the gas-cooler with an inlet of the first stage of the motor-driven compressor for recovering a predetermined quantity of coolant.

19 Claims, 3 Drawing Sheets

NATURAL COOLANT REFRIGERATING PLANT

This application claims priority to Italian Patent Application BO2011A000384 filed Jun. 29, 2011, the entirety of which is incorporated by reference herein.

BACKGROUND OF THE INVENTION

This invention relates to a natural coolant refrigerating plant.

More specifically, this invention relates to a natural coolant refrigerating plant used on machines for pasteurizing and/or producing confectionery products, such as ice creams, sorbets, custards, Bavarian cream and the like.

As is known, refrigerating plants used in machines for pasteurizing confectionary products not only heat the product in order to eliminate any bacteriological loads present, but also perform a subsequent cooling so as to carry the product to a suitable temperature for dispensing.

In other words, the coolant circulating in the plant is used as a heat exchange fluid, both for heating and cooling the product.

However, these plants need to use different coolant quantities or loads, depending on whether they are performing a product heating or cooling cycle.

More in detail, during the heating cycle, the plant would need a greater coolant load compared with that required during the cooling cycle.

Further, prior art natural coolant plants usually use a motor-driven compressor with two compression stages and they use a first heat exchanger, the so-cooled intercooler, for cooling the coolant flowing out from the first compression stage, and a second heat exchanger, the so-called gas-cooler, for cooling the coolant flowing out from the second compression stage.

The prior art plants which are able to both heat and cool the product being processed as described have the drawback of not being able to adequately control the requested coolant load.

More specifically, since a greater coolant load is requested during heating, these plants are usually designed according to this quantity of coolant.

However, during the cooling cycle, part of the coolant is not used, since it is not necessary.

As this part of the coolant is not used, there is a consequent lowering of the overall efficiency of the plant.

Further, even during the heating cycle the plant would still not be able to use this quantity of coolant, which would often remain entrapped inside the intercooler.

Thus, there would be a reduction in the overall efficiency of the plant even during the heating cycle.

SUMMARY OF THE INVENTION

In this context, the technical purpose of this invention is to provide a natural coolant refrigerating plant which overcomes the aforementioned drawbacks.

According to this invention, the technical purpose and the aforementioned aims are achieved by a natural coolant refrigerating plant comprising the technical features described herein.

BRIEF DESCRIPTION OF THE DRAWINGS

Further features and advantages of the invention are more apparent in the non-limiting description which follows of a preferred non-limiting embodiment of a natural coolant refrigerating plant illustrated in the accompanying drawings, in which.

DESCRIPTION OF THE PREFERRED EMBODIMENTS

Figure 1:
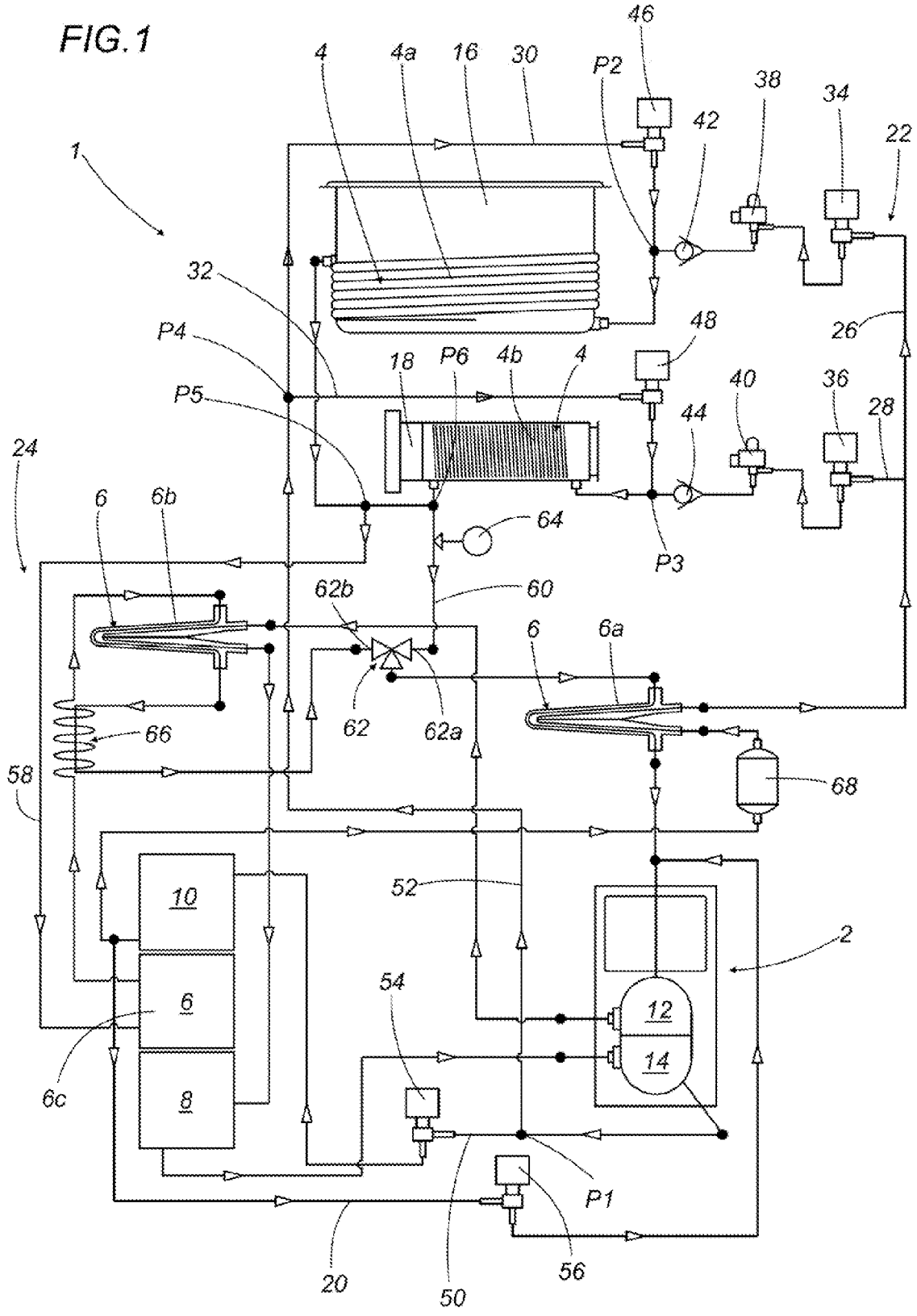
FIG. 1 schematically shows a first embodiment of the plant according to this invention.

With reference to FIG. 1 the numeral 1 denotes a natural coolant refrigerating plant according to the invention.

The plant 1, as illustrated, comprises a motor-driven compressor 2 with two compression stages, at least one jacket 4 for heating and/or cooling a product being processed, at least one heat exchanger 6 in fluid communication with the motor-driven compressor 2 and with jacket 4, an intercooler 8 located upstream of the second compression stage, a gas-cooler 10 located downstream of the outlet from the second compression stage.

The first compression stage of the motor-driven compressor 2 is indicated in the figures with the numeral 12, whilst the second stage is indicated with the numeral 14.

Moreover, the term "intercooler" indicates a heat exchanger which uses air or water as heat exchange fluid. The intercooler 8 is used for lowering or raising the temperature of the coolant before it enters the second stage 14 of the motor-driven compressor 2. In this way, there is an increase in the efficiency of the motor-driven compressor 2.

The term "gas-cooler" is used to indicate a heat exchanger, used usually for cooling with a gas coolant. This also uses water or, preferably, air as heat exchange fluid.

Specifically, the plant 1 according to this invention uses a natural coolant, consisting substantially of carbon dioxide.

Yet more specifically, the plant 1, according to this invention, forms a reversible transcritical carbon dioxide cycle.

The gas-cooler 10 is used for cooling the carbon dioxide flowing from the second compression stage 14.

The intercooler 8 and the gas-cooler 10 have embodiments of a known type, and will not therefore be described in further detail.

As stated above, the plant 1 may, purely by way of an example, be installed on typical machines for producing confectionary products such as ice creams, custards, Bavarian cream and the like.

In this regard, it should be noted that these types of machines for the instantaneous production and dispensing of cake and pastry fillings, ice cream products and the like can process a basic product at the same moment the dispensing of a quantity of processed product is requested.

Figure 3:
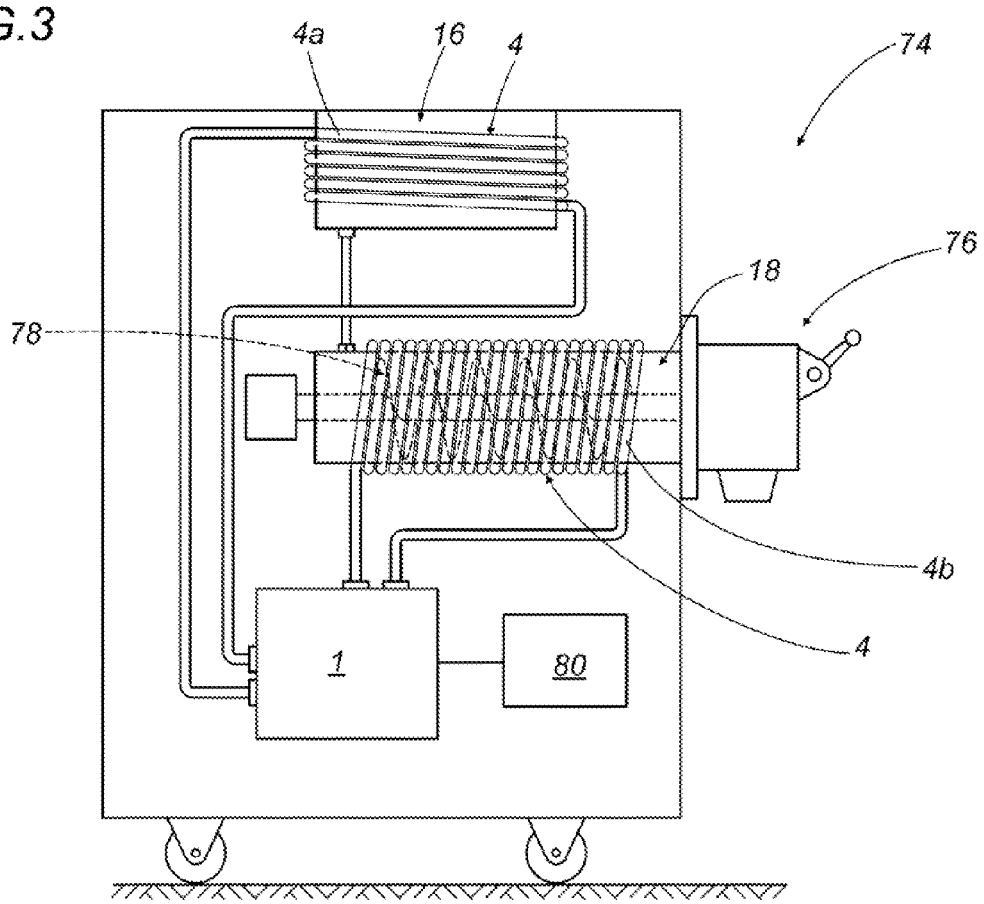
FIG. 3 schematically shows a machine for making and dispensing semi-liquid and/or semi-solid food products such as, for example, soft ice cream and the like, using a plant of FIG. 1 or FIG. 2.

As schematically illustrated in FIG. 3, referring for the sake of simplicity, but without limiting the scope of the invention, to a machine 74 for the production and dispensing of semi-liquid and/or semi-solid food products such as, for example, soft ice cream and the like, this has a tank 16 for collecting the food product to be processed, a processing cylinder 18, the so-called cooling and mixing unit, connected to the collection tank 16, a tap 76 for dispensing the product flowing from the processing cylinder 18 and a stirrer 78 inside the processing cylinder 18 for mixing the chocolate being processed.

The machine 74 also has means for cooling and/or heating the collection tank 16 and the processing cylinder 18.

Of the machine 74, the tank 16 for collecting the product to be processed and the cylinder 18 for processing the product are illustrated in the accompanying drawings.

The plant 1 comprises the above-mentioned cooling and/or heating means.

The plant has a first 4*a* and a second 4*b* jacket for heating and/or cooling the product being processed.

The first jacket 4*a* is associated with and located around the collection tank 16.

The second jacket 4*b* is associated with and located around the processing cylinder 14.

The plant 1 comprises a first branch 20, connecting the outlet of the gas-cooler 10 with the inlet of the first stage 12 of the motor-driven compressor 2.

This connection, by the first branch 20, allows the recovery of a predetermined quantity of coolant.

More in detail, this quantity is the quantity of coolant which would otherwise remain unused during operation, and which would cause the lowering of the overall efficiency of the plant 1.

The recovery of the load is essential since there would otherwise be the further problem that the unused coolant, by reducing the overall flow of coolant flowing in the plant 1, would cause an increase in the individual cycle times.

The plant 1 also has a first circuit 22 for cooling the product to be processed and a second circuit 24 for heating the product.

The first 22 and the second 24 circuit have a respective inlet for the coolant, and a respective outlet for the coolant.

The first 22 and the second 24 circuit are connected together, at the inlet, at a point P1, at the outlet of the second stage 14 of the motor-driven compressor 2.

They are connected, at the outlet, respectively at the inlet of the first 4*a* and at the inlet of the second 4*b* heating and/or cooling jacket.

Figure 2:
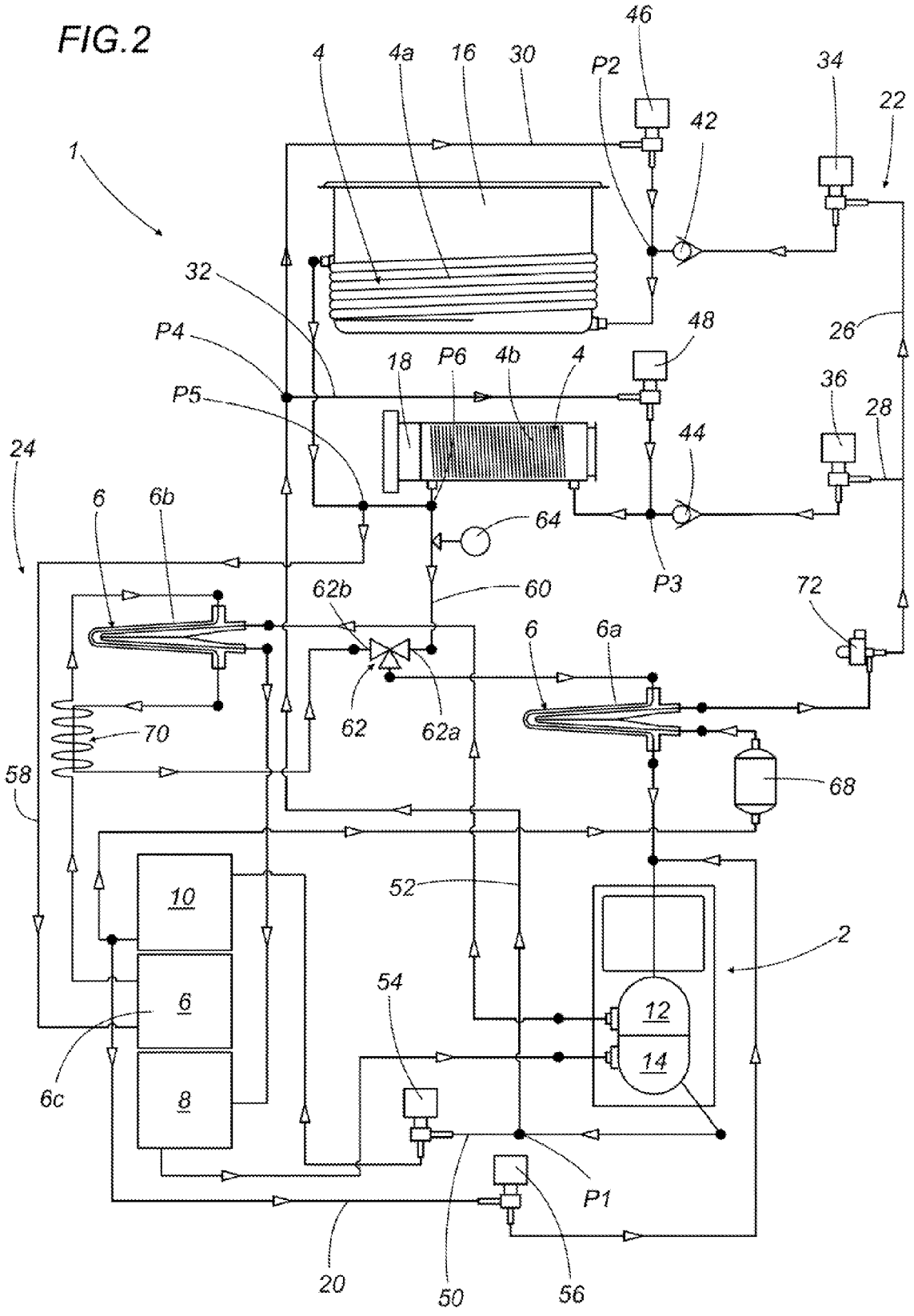
FIG. 2 shows a second embodiment of the plant according to this invention.

FIGS. 1 and 2 show in particular, at the inlet to the first jacket 4*a* and to the second jacket 4*b* for heat exchange, a second branch 26 and a third 28 branch, respectively, relative to the first cooling circuit 22.

Similarly, for the second heating circuit 24, a fourth 30 and a fifth 32 inlet branch is shown, respectively, to the first 4*a* and to the second 4*b* jacket.

The second 26 and fourth 30 branch connect, upstream of the first jacket 4*a*, at a point P2.

The second 28 and fifth 32 branch connect, upstream of the second jacket 4*b*, at a point P3.

The plant 1 has, in particular, upstream of the first 4*a* and of the second 4*b* jacket, at least one respective electronically controlled on-off valve or solenoid valve.

The plant 1, and more precisely the first cooling circuit 22, has a first solenoid valve 34, located on the second branch 26, and a second solenoid valve 36, located on the third branch 28.

The first 34 and the second 36 solenoid valves can be activated and/or adjusted by an electronic adjustment unit, indicated for simplicity with the numeral 80 only in FIG. 3.

In general, all the valves of an electronic type present in the circuit referred to in the description are controlled by the adjustment unit 80.

The first cooling circuit 22 has, at the second branch 26, downstream of the first solenoid valve 34, a first lamination (expansion) valve 38; at the third branch 28, the first circuit 22 has a second lamination (expansion) valve 40.

Preferably, the lamination valves 38, 40 are of the electronic type.

Further, the second 26 and the third 28 branch, downstream of the respective lamination valves 38, 40, have, respectively, a first 42 and a second 44 automatic non-return valve. The non-return valves 42, 44 prevent any leakages towards the first 34 and the second 36 solenoid valves, due to possible backpressures during a product heating cycle.

The second heating circuit 24 has, however, a third solenoid valve 46 located on the fourth branch 30 and a fourth solenoid valve 48 located on the fifth branch 32.

At the point P1, the inlet to the first circuit 22 is formed by a sixth branch 50; whilst the inlet to the second circuit 24 is formed by a seventh branch 52.

The sixth branch 50 is connected at one end to the outlet of the second stage 14 of the motor-driven compressor 2, at the point P1, whilst at the opposite end it is connected to the inlet of the gas-cooler 10.

Since the coolant flowing out from the second stage 14 of the motor-driven compressor 2 has a high temperature, the coolant may be used directly for heating the product in tank 16 and in cylinder 18.

To achieve this, on the sixth branch 50 is mounted a fifth solenoid valve 54, which is moved to the closed configuration, so as to allow the coolant, flowing out from the second stage 14, to flow exclusively along the seventh branch 52, towards the first 4*a* and the second 4*b* heating and/or cooling jacket.

The seventh branch 52 is divided into the fourth 30 and the fifth 32 branch, at a point P4, directing the coolant towards the first 4*a* and the second 4*b* jacket.

More specifically, during a heating cycle, if the coolant, flowing out from the second compression stage 14, has an excessively high pressure, the fifth solenoid valve would be opened 54 allowing a part of the coolant to discharge into the gas-cooler 10, thereby lowering the coolant pressure.

The plant 1 also has at least one heat exchanger 6 located upstream and/or downstream of the motor-driven compressor 2.

More in detail, the plant 1 comprises a first heat exchanger 6*a*, located upstream of the motor-driven compressor 2, and a second heat exchanger 6*b*, located downstream of the outlet from the first compression stage 12. Further, the plant 1 comprises a third heat exchanger 6*c* located upstream of the inlet of the second stage 14 of the motor-driven compressor 2.

The heat exchangers 6*a*, 6*b*, 6*c* will be described in more detail below, together with a more precise description of the product heating and cooling cycles.

With reference to what has already been stated above, a sixth solenoid valve 56 is mounted on the first branch 20, for recovering part of the coolant contained in the gas-cooler 10.

The sixth valve 56 allows a "controlled" recovery of the coolant contained in the gas-cooler 10 along the first branch 20. In other words, the recovery of the coolant contained in the gas-cooler 10 does not occur automatically, but occurs by means of a command for opening the sixth valve 56, sent by the adjustment unit 80.

Moreover, when open, the sixth valve 56 allows balancing of the pressures between the first 12 and the second 14 compression stage every time the motor-driven compressor 2 is stopped; in this way, the stresses on the stationary rotor of the compressor 2 are reduced and the pickup at the following start up is favoured.

The sixth valve 56 is kept open for a predetermined length of time, so as to recover a precise and defined quantity of coolant.

Alternatively, the sixth valve 56 may kept open until a predetermined and set value of a predetermined quantity is reached. The reaching of this quantity also defines the possibility of recovering a very precise quantity of coolant.

This quantity is measured upstream or downstream of the sixth solenoid valve 56.

It is preferable that the quantity is measured immediately downstream of the first 4*a* and of the second 4*b* heating and/or cooling jacket.

As shown in the accompanying drawings, the respective outlets of the first 4*a* and second 4*b* jacket reconnect at point P5. At that point P5 the outlets of the first 4*a* and the second 4*b* jacket are connected with the inlet of the third heat exchanger 6*c*, by an eighth branch 58.

As will be explained in more detail below, the coolant fluid flows along the eighth branch 58 when the product is being heated.

In the case of a product cooling cycle, the coolant, flowing out from the first 4*a* and the second 4*b* jacket, flows, however, along a ninth branch 60.

The ninth branch 60 has an end connected to the outlet of the first jacket 4*a* and to the outlet of the second jacket 4*b*, at a point P6.

The end opposite the ninth branch 60 is, however, connected to a first inlet 62*a* of a 3-way valve 62.

The 3-way valve 62 is also, preferably, adjusted by the adjustment unit 80.

The quantity defining the opening of the sixth solenoid valve 56 is, preferably, measured on the ninth branch 60.

More specifically, it is advantageous to measure, as the quantity, the pressure of the coolant flowing out from the thermal heating and/or cooling jackets 4*a*, 4*b*.

The pressure of the coolant is measured by a pressure transducer 64 mounted on the ninth branch 60.

The transducer 64 sends a signal indicating the pressure measured at the adjustment unit 80, which in turn controls the sixth solenoid valve 56 on the basis of the signal sent to it.

Upon starting a heating cycle, the fifth solenoid valve 54 is closed, allowing the coolant to only flow along the seventh branch 52.

The sixth solenoid valve 56 of the first branch 20 is then opened, allowing recovery of the predefined quantity of coolant, which is drawn in by the motor-driven compressor 2.

The coolant, flowing out from the second stage 14 of the motor-driven compressor 2, flowing along the seventh branch 52, reaches point P4.

The hot coolant now flows along the fourth 30 and the fifth 32 branch, reaching the first 4*a* and the second 4*b* jacket.

More specifically, the third 46 and the fourth 48 solenoid valves are alternately opened, for allowing the selective passage of the hot coolant towards the first 4*a* or the second 4*b* jacket.

Alternatively, the valves 46, 48 may be simultaneously moved to the open configuration, allowing the hot coolant to simultaneously reach the first 4*a* and the second 4*b* jacket.

The coolant flowing out from the first jacket 4*a* rejoins the coolant flowing out from the second jacket 4*b* at point P5.

The coolant is only able to flow along the eighth branch 58, since the ninth branch 60 constitutes a blind branch up to the 3-way valve 62.

It is, however, possible to measure the pressure of the coolant flowing out from the respective jackets.

The fluid, flowing along the eighth branch 58, reaches the inlet of a third heat exchanger 6*c*, where it is cooled by a flow of air.

After that, the coolant flowing out from the third heat exchanger 6*c* is expanded in a lamination (expansion) device 66.

The expanded coolant reaches the second heat exchanger 6*b*, where it evaporates removing heat from the coolant coming from the first stage 12 of the motor-driven compressor 2. In effect, the coolant flowing out from the first stage 12 enters into the second heat exchanger 6*b* in co-current flow relative to the coolant coming from the lamination device 66.

After evaporating, the coolant reaches the 3-way valve 62, and then reaches the first heat exchanger 6*a* located upstream of the motor-driven compressor 2.

The coolant does not exchange heat in the first heat exchanger 6*a* since there is no counter-current or co-current flow.

The coolant therefore reaches the inlet of the motor-driven compressor 2.

As mentioned above, the coolant flowing out from the first stage 12 of the motor-driven compressor 2 reaches the second heat exchanger 6*b* transferring heat.

Subsequently, it reaches the inter-cooler 8 where it is again heated by a flow of air at ambient temperature.

Lastly, the coolant enters the second stage 14 of the motor-driven compressor 2 to start a new heating cycle.

As regards a product cooling cycle, the coolant flowing out from the second compression stage 14 in this case flows along the sixth branch 50 in the direction of the gas-cooler 10.

More in detail, the third 46 and the fourth 48 solenoid valve are closed, preventing the coolant from flowing along the seventh branch 52.

More specifically, the fifth solenoid valve 54 is kept open for the entire duration of the cycle.

The coolant is cooled inside the gas-cooler 10 and subsequently, after flowing out, reaches the first heat exchanger 6*a*.

If necessary, a filter 68 can be located between the gas-cooler 10 and the first heat exchanger 6*b* in such a way that any solid particles do not reach the first heat exchanger 6*a* and the lamination valves 38, 40 located upstream of the first 4*a* and the second 4*b* jacket.

In the first heat exchanger 6*a*, the coolant transfers heat to the coolant coming, in counter-current, from the first 4*a* and the second 4*b* jacket.

Flowing out from the first heat exchanger 6*a*, the coolant reaches the first 34 and the second 36 solenoid valve, and the first 38 and the second 40 lamination valve.

Also in this case, the coolant may be fed to the respective jackets in a selective manner, alternating the opening of the first 34 and the second 36 solenoid valve.

In addition, the first 34 and the second 36 solenoid valve can allow the passage of the coolant simultaneously towards the first 4*a* and the second 4*b* jacket.

Flowing out from the respective jackets, the coolant is allowed to flow exclusively along the ninth branch 60, at the point P6. This occurs since the 3-way valve 62 is switched so as to allow the passage of the fluid along the ninth branch 60 and not along the eighth branch 58.

The coolant reaches the 3-way valve 62 and then the first heat exchanger 6*a*. As already mentioned, in the first heat exchanger 6*a* the coolant receives in this case the heat of the coolant flowing out from the gas-cooler 10.

Flowing out from the first heat exchanger 6*a* the coolant reaches the inlet of the motor-driven compressor 2 and the inlet of the first compression stage 12.

Flowing out from the first stage 12 the coolant reaches the second heat exchanger 6*b*, where it does not exchange heat since, as mentioned above, there is no counter-current coolant flow.

Flowing out from the second heat exchanger 6*b* the coolant reaches the intercooler 8, where it is cooled by a counter-current flow of air.

Lastly, it is drawn back to the second compression stage 14, to restart a new cooling cycle.

According to a second embodiment, illustrated in FIG. 2, the plant 1 has a first electronic lamination (expansion) device 70 in place of the lamination device 66 located at the outlet of the third heat exchanger 6*c*.

More specifically, as mentioned above, this lamination device 70 acts on the coolant during a heating cycle.

Further, the plant 1 has a second electronic lamination (expansion) device 72, which acts on the coolant during a cooling cycle. More in detail, the second electronic lamination device 72 is located upstream of the first 34 and the second 36 solenoid valve, in place of the previous respective lamination valves 38, 40 located downstream.

More in detail, with regard to what has already been stated above for the first embodiment, the various electronic lamination valves present are also preferably controlled by an electronic adjustment unit 80, not illustrated in the drawings.

These replacements result, advantageously, in an optimization of the heating and cooling cycles, since means of lamination are now available which are not fixed but adjustable through the temperature and evaporation pressure values.

The plant 1 as described has many advantages.

Firstly, the plant 1 may be used on machines for the production of cold confectionary products, such as ice creams or sorbets, but also on machines for the production of hot confectionary products, such as custards or Bavarian cream.

Moreover, the plant 1 allows the overall efficiency of the machine to be maximized, during both the product cooling cycle and the heating cycle.

The plant 1 has the important advantage of being able to use a single load of coolant, regardless of the quantities requested during the cooling and during the heating.

The plant 1 makes it possible to obtain the above by simple structural measures and simple control systems.

What is claimed is:

1. A natural coolant refrigerating plant comprising:

a motor-driven compressor with a first compression stage and a second compression stage, at least one container for containing a food product to be processed;

at least one jacket associated with the at least one container for at least one chosen from heating and cooling the food product to be processed, a first circuit for cooling the food product to be processed;

a second circuit for heating the food product to be processed;

the first circuit and the second circuit each having an inlet connected together to receive coolant from an outlet of the second compression stage;

the first circuit and the second circuit each having an outlet connected to the at least one cooling jacket to supply coolant to the at least one cooling jacket;

at least one valve positioned between the at least one cooling jacket and the outlets of the first circuit and second circuit for selectively connecting the first circuit to the at least one cooling jacket for cooling the food product to be processed and the second circuit to the at least one cooling jacket for heating the food product to be processed;

an intercooler located upstream of the second compression stage, a gas-cooler located downstream of an outlet from the second compression stage and forming part of the first circuit;

a first branch connecting an outlet of the gas-cooler with an inlet of the first compression stage of the motor-driven compressor for recovering a predetermined quantity of coolant;

a first branch valve positioned in the first branch for controlling flow of coolant in the first branch;

a controller controlling the first branch valve to 1) block coolant flow through the first branch when the at least one valve is controlled to selectively connect the first circuit to the at least one cooling jacket for cooling the food product to be processed and to 2) flow coolant through the first branch when the at least one valve is controlled to selectively connect the second circuit to the at least one cooling jacket for heating the food product to be processed.

2. The plant according to claim 1, wherein the first branch valve includes at least one chosen from an electronically controlled on-off valve and a solenoid valve.

3. The plant according to claim 2, wherein the first branch valve is kept open for a predetermined and set time to flow coolant.

4. The plant according to claim 2, wherein the first branch valve is kept open until a predetermined and set value of a predetermined parameter is reached.

5. The plant according to claim 4, wherein the predetermined parameter is measured upstream or downstream of the first branch valve.

6. The plant according to claim 4, wherein the predetermined parameter is measured downstream of the at least one jacket.

7. The plant according to claim 5, wherein the predetermined parameter measured is a pressure of the coolant.

8. The plant according to claim 1, wherein the at least one jacket includes a first jacket and a second jacket for at least one chosen from heating and cooling the product being processed.

9. The plant according to claim 8, wherein the at least one valve can control the first circuit and second circuit for at least one chosen from simultaneous heating, simultaneous cooling and simultaneous heating and cooling of the first jacket and the second jacket.

10. The plant according to claim 8, wherein the at least one valve includes a first and a second valve, located, respectively, upstream of the first and the second jacket, for intercepting the coolant for cooling the product; a third and a fourth valve, located, respectively, upstream of the first and the second jacket, for intercepting the coolant for heating the product.

11. The plant according to claim 1, comprising at least one heat exchanger.

12. The plant according to claim 1, comprising a first heat exchanger located upstream of the motor-driven compressor, a second heat exchanger located upstream of the intercooler and a third heat exchanger located downstream of the at least one jacket.

13. The plant according to claim 12, comprising an expansion device, located downstream of the third heat exchanger.

14. The plant according to claim 1, comprising a first on-off valve and a second on-off valve, and a first expansion valve and a second expansion valve located, respectively, downstream of the first and the second on-off valves.

15. The plant according to claim 12, comprising a first electronic expansion device, located downstream of the third heat exchanger.

16. The plant according to claim 15, comprising a first on-off valve and a second on-off valve, and a second electronic expansion device, located upstream of the first and the second on-off valves.

17. The plant according to claim 1, wherein the natural coolant comprises at least carbon dioxide.

18. A machine for making and dispensing at least one chosen from a semi-liquid food product and a semi-solid food product selected from the group including cake, pastry fillings and ice cream products, comprising a natural coolant refrigerating plant according to claim 1.

19. The machine according to claim 18, wherein the at least one container includes a collection tank for collecting the food product to be processed, a processing cylinder connected to the collection tank, a tap for dispensing the food product flowing from the processing cylinder, a stirrer for mixing the food product located inside the processing cylinder, wherein the at least one cooling jacket includes a first cooling jacket for the collection tank and a second cooling jacket for the processing cylinder.

* * * * *